US006455818B1

(12) United States Patent
Arntz et al.

(10) Patent No.: US 6,455,818 B1
(45) Date of Patent: Sep. 24, 2002

(54) DOWNDRAFT FILTER ASSEMBLY FOR A COOKING APPLIANCE

(75) Inventors: Timothy J. Arntz, Cleveland, TN (US); S. Todd Brooks, Cleveland, TN (US); David M. Lorenz, Cleveland, TN (US); Mark A. Pickering, Cleveland, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/934,492

(22) Filed: Aug. 23, 2001

(51) Int. Cl.[7] ..... H05B 3/68; F24C 15/20
(52) U.S. Cl. ..... 219/452.11; 126/299 R
(58) Field of Search ..... 219/452.11, 452.12, 219/460.1; 126/21 R, 21 A, 299 R, 299 D

(56) References Cited

U.S. PATENT DOCUMENTS

| | | | | |
|---|---|---|---|---|
| 3,409,005 | A | | 11/1968 | Field |
| 3,470,680 | A | | 10/1969 | Avera |
| 4,042,806 | A | | 8/1977 | McCartney |
| 4,105,422 | A | | 8/1978 | Kiguchi |
| 4,409,954 | A | | 10/1983 | Berlik et al. |
| 4,446,849 | A | | 5/1984 | McFarland |
| 4,457,293 | A | | 7/1984 | Berlik |
| 4,562,827 | A | | 1/1986 | Cerola |
| 4,759,196 | A | | 7/1988 | Davis |
| 4,765,811 | A | | 8/1988 | Beckon |
| 4,889,104 | A | * | 12/1989 | Gostelow ..... 126/299 R |
| 5,231,972 | A | * | 8/1993 | Galassi ..... 126/299 R |
| 5,269,824 | A | | 12/1993 | Takita |
| 5,524,607 | A | | 6/1996 | Grohman et al. |
| 5,619,982 | A | | 4/1997 | Kelly et al. |
| 5,863,310 | A | | 1/1999 | Brown et al. |
| 5,884,619 | A | | 3/1999 | Terry |
| 5,906,195 | A | | 5/1999 | Georgaras |
| 6,132,483 | A | * | 10/2000 | Andrews ..... 210/445 |

* cited by examiner

*Primary Examiner*—Sang Paik
(74) *Attorney, Agent, or Firm*—Diederiks & Whitelaw, PLC

(57) ABSTRACT

A filtering system for a downdraft cooking appliance includes a filter assembly arranged directly below an air grill leading to a venting plenum. The filter assembly includes a liner which supports a filter element and is removably positioned inside the plenum. The filter element can be arranged inside the liner, attached thereto or insert molded into the liner material. The liner is preferably suspended from the air grill so as to be readily removable in unison with the grill for inspection, cleaning or replacement. In a preferred embodiment, the liner is formed with opposing, outwardly projecting flanges which slide into mating channels formed into the underside of the grill. With this arrangement, exposure of the wall surfaces of the plenum to the cooking byproducts is minimized, thereby greatly reducing any necessary cleaning of these surfaces.

25 Claims, 2 Drawing Sheets

DOWNDRAFT FILTER ASSEMBLY FOR A COOKING APPLIANCE

BACKGROUND OF THE INVENTION

1. Field of the Invention

The present invention pertains to the art of cooking and, more particularly, to a filter assembly for a downdraft cooking appliance.

2. Discussion of the Prior Art

In the art of cooking appliances, it is known to incorporate a downdraft to vent air containing moisture, suspended grease particles and/or other cooking byproducts developed during a grilling or other cooking operation. In a typical downdraft cooking appliance, a motor driven blower system is connected to a plenum which is integrated into the appliance. During operation of the blower, the air is drawn away from a cooking zone through a grill and expelled from the appliance.

In such a venting system, it is desirable to remove the grease and other byproducts from the air stream within the plenum at a position upstream of the blower in order to protect the mechanical components of the blower, as well as other components of the venting system located downstream of the blower, from potential corrosive effects. To this end, it is known to provide a filter, such as a multi-layer aluminum mesh filter, in the plenum, upstream of the blower. The filter is positioned at an angle in order to increase the effective surface area of the filtering media, thereby minimizing any pressure drop created by the introduction of the filter in the air stream.

A filtering arrangement for a downdraft cooking appliance as described above is represented in U.S. Pat. No. 5,619,982. With such an arrangement, the angling of the filter and the positioning of the filter at a distance below the grill of the downdraft system exposes side wall portions of the plenum, between the filter and the grill, to the grease laden air. The surfaces of the plenum upstream of the filter will inherently collect grease and other byproduct particles which have to be periodically cleaned. Obviously, the task of cleaning these surfaces is less than desirable. In addition, exposure to these surfaces must occur when the filter is accessed for inspection, cleaning and/or replacement.

Based on the above, there exists a need in the art for a filter assembly for a downdraft cooking appliance which is constructed so as to avoid the need to routinely clean the surfaces of a plenum. In addition, there exists a need in the art of downdraft cooking appliances for a filter assembly which can be easily accessed for inspection, cleaning and/or replacement.

SUMMARY OF THE INVENTION

The present invention is directed to a filter assembly for a downdraft cooking appliance including a filter arranged directly below an air grill leading to a venting plenum. In accordance with the most preferred embodiment, a liner, which supports the filter, is removably positioned inside the plenum. The filter can be arranged inside the liner, attached thereto through the use of mechanical fasteners such as rivets or epoxy, or insert molded into the liner material. The liner is preferably suspended from the air grill so as to be readily removable in unison with the grill for inspection, cleaning or replacement. In a preferred embodiment, the liner is formed with opposing, outwardly projecting flanges which slide into mating channels formed into the underside of the grill.

With this arrangement, the filter is optimally positioned directly at the opening of the plenum. The liner, which defines the area exposed to the grease laden air, can be easily removed for inspection, cleaning and/or replacement. Correspondingly, exposure of the plenum to the cooking byproducts is minimized, thereby greatly reducing the necessary cleaning frequency of these surfaces. The filter is preferably V-shaped to optimize the surface area exposed to the air flowing into the plenum. Furthermore, the filter can be easily detached from the grill for replacement purposes.

Additional objects, features and advantages of the present invention will become more readily apparent from the following detailed description of preferred embodiments thereof when taken in conjunction with the drawings wherein like reference numerals refer to corresponding parts in the several views.

DETAILED DESCRIPTION OF THE PREFERRED EMBODIMENTS

Figure 1:
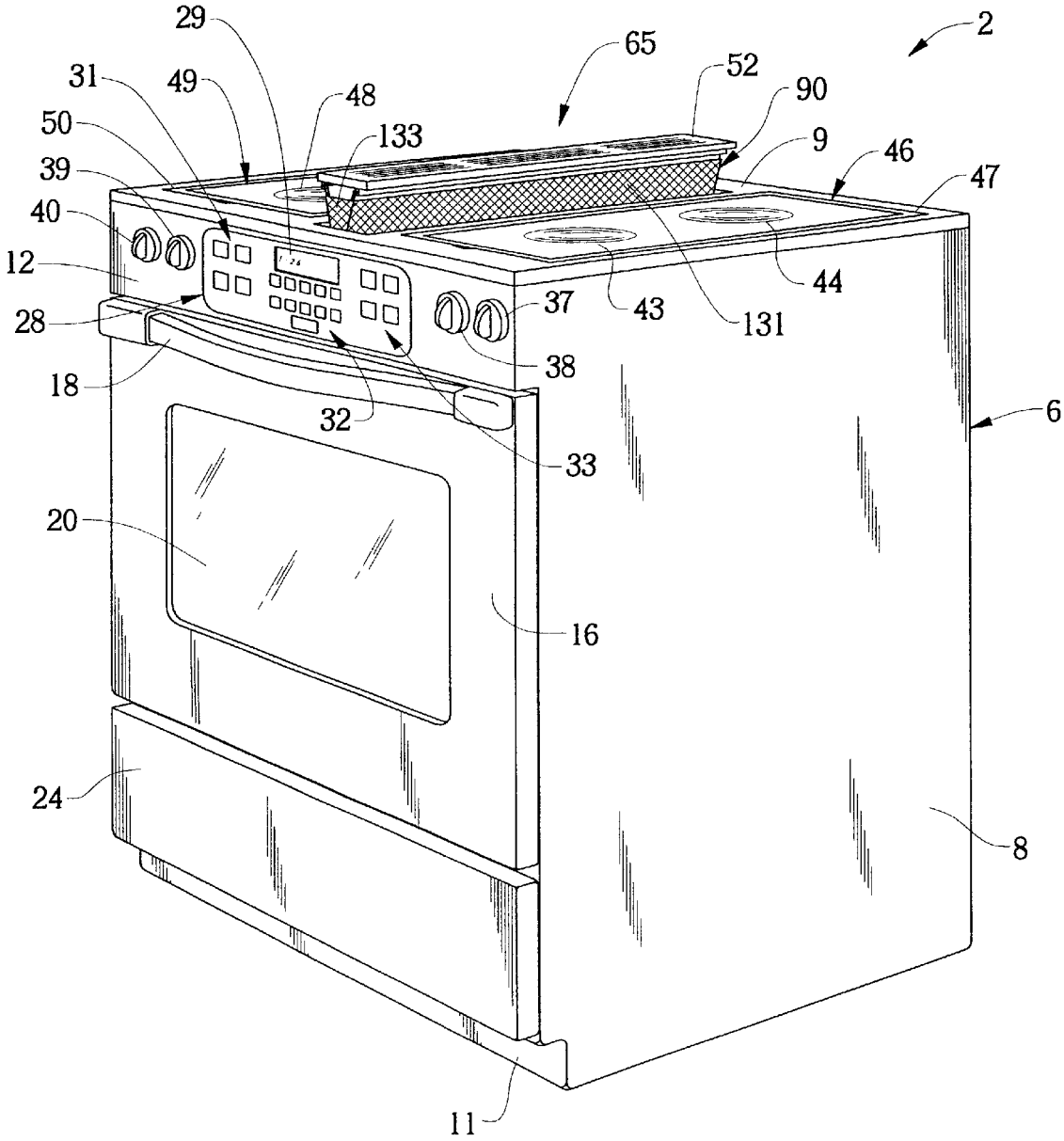
FIG. 1 is a perspective view of a cooking appliance incorporating the downdraft filter assembly of the present invention.

With initial reference to FIG. 1, a cooking appliance, generally indicated at 2, is shown to take the form of a range. Cooking appliance 2 includes a cabinet 6 including opposing side panels 8, a cooktop 9, a rear panel (not shown) and a front panel 11. An upper portion of front panel 11 defines a face 12 that includes a plurality of controls as will be more fully described below. Arranged below upper front face 12 is an oven door 16 having a handle 18 and a window 20. In a manner known in the art, door 16 can be pivoted to access an interior oven cavity (not separately labeled) of cooking appliance 2. Also, as shown, cooking appliance 2 includes a lower drawer 24 for use in storing pans and the like.

In the embodiment illustrated, upper front face 12 is provided with a central oven control section 28 that includes a display 29 and various sets of control buttons 31–33. Although not considered part of the present invention, for sake completeness, control button set 31 is preferably utilized to establish a desired mode of operation for the oven of cooking appliance 2, control button set 32 represents a numeric pad including a cancel button, and control button set 33 represents program buttons for establishing desired cook times, clock settings and the like. In addition, upper front face 12 is provided with a plurality of element control knobs 37–40. In this embodiment, element control knobs 37 and 38 are utilized to control the operation of upper heating elements 43 and 44 respectively. In the most preferred embodiment, upper heating elements 43 and 44 are integrated into a first cartridge 46 which is adapted to be selectively placed within a first opening 47 formed in cooktop 9. In a corresponding manner, element control knobs 39 and 40 are adapted to control the operation of additional upper heating elements, one being shown at 48, which are integrated into a second cartridge 49 that is received within a second opening 50 formed in cooktop 9. At this point, it should be realized that various different types of heating elements, including electric and gas elements, could be employed in connection with the present invention. Also cooktop 9 could be provided directly in a kitchen countertop instead of constituting part of a range without departing from the invention.

In general, the construction and operation of cooking appliance 2 as described until this point is known in the art such that this description has merely been provided for the sake of completeness. To this end, additional details of this construction or operation will not be provided here. However, FIG. 1 illustrates a slotted grill 52 which is arranged between first and second cartridges 46 and 49 and forms part of an overall downdraft system, generally indicated in FIG. 2 at 75. As shown, downdraft system 75 includes a plenum 80 having various sidewalls (not separately labeled) which lead from cooktop 9 to an exhaust conduit 82, a blower or fan 84 interposed between plenum 80 and exhaust conduit 82, grill 52, and a filter assembly 90 generally defined by a liner 92, and one or more filter elements 94. In a manner similar to known downdraft cooking systems, downdraft system 75 is used to exhaust grease, smoke and/or other byproducts developed when cooking on cooktop 9. In the embodiment shown, downdraft system 75 can be controlled through one of the buttons in central oven control section 28 or automatically whenever any one of element control knobs 37–40 are placed in an activated state.

Figure 2:
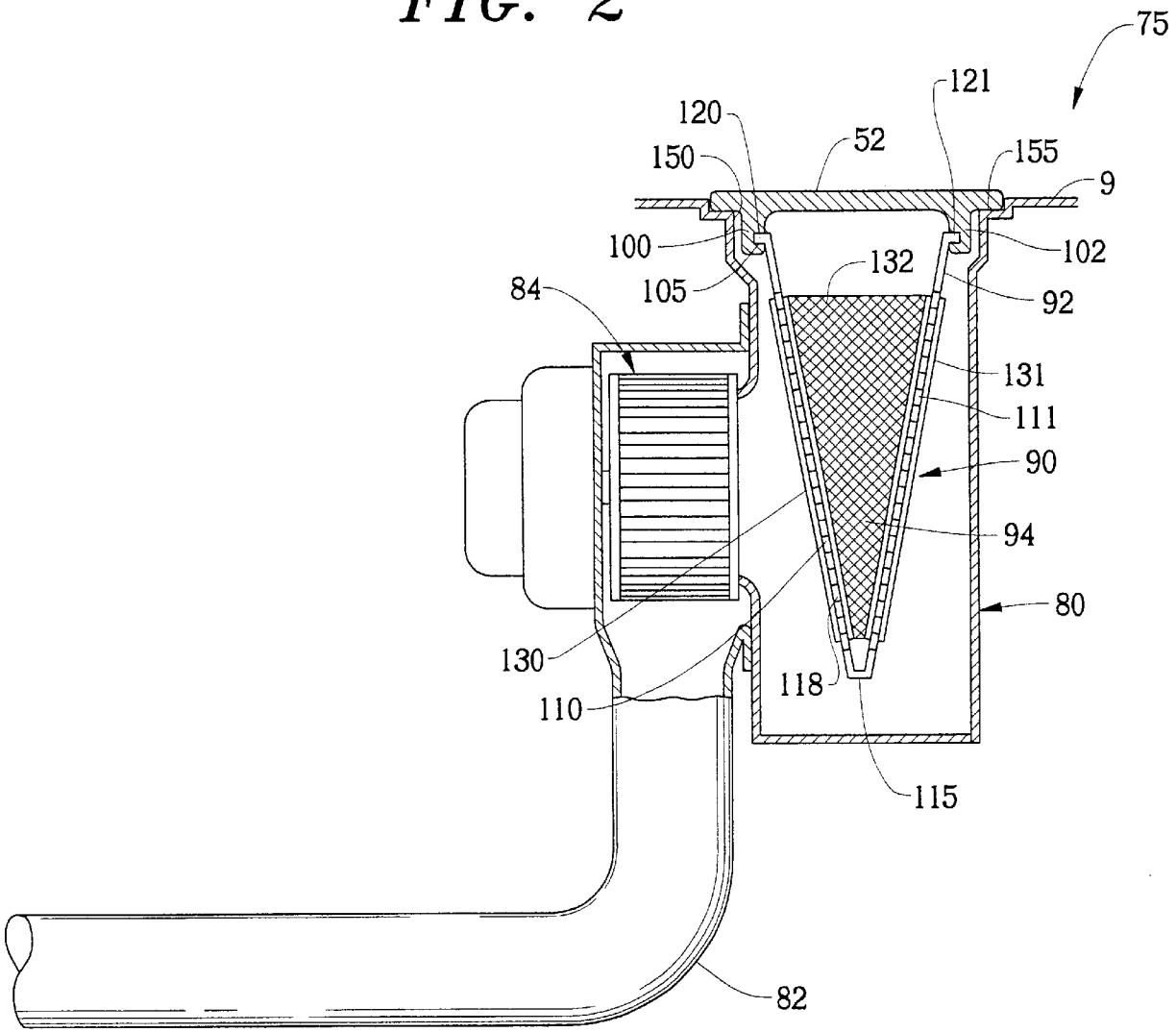
FIG. 2 is partial cross-sectional view of a section of the downdraft filter assembly.

As clearly shown in each of FIGS. 1 and 2, filter assembly 90 is suspended from grill 52 such that the lifting of grill 52 relative to cooktop 9 functions to remove filter assembly 90 from within plenum 80. In accordance with the most preferred form of the invention, grill 52 is formed with a pair of spaced, elongated bosses 100 and 102, with each boss 100, 102 being formed with an elongated, preferably open-ended channel 105. As clearly shown in FIG. 2, channels 105 are preferably arranged in a common plane and face each other. Liner 92 constitutes a housing which is preferably molded in a generally V-shaped configuration with side walls 110 and 111 meeting at a lower vortex region 115. Each of side walls 110 and 111 is perforated as indicated by the various holes 118. The upper ends of side walls 110 and 111 define outwardly extending flanges 120 and 121 respectively. Flanges 120 and 121 are sized to be slidably received within channels 105 of bosses 100 and 102. Therefore, with this construction, liner 92 can be readily detached from grill 52 by lifting grill 52 so as to remove filter assembly 90 from within plenum 80 and then sliding flanges 120 and 121 out of channels 105.

For purposes of the remainder of this discussion, reference will be made to a single filter element 94. However, as indicated above, filter assembly 90 can include one or more filter elements 94. Preferably, filter element 94 takes a generally V-shaped configuration with elongated side portions 130 and 131, as well as end portions 132 and 133. The filter element 94 is preferably V-shaped to optimize the surface area exposed to the air flow into plenum 80. In any event, filter element 94 extends about the entire periphery of liner 92 and across the entire area of perforations or holes 118 of liner 92 which is also V-shaped. Filter element 94 can be directly, mechanically fastened to liner 92, such as through the use of rivets, epoxy or the like. Filter element 94 can also be constituted by a cartridge that is simply inserted between side walls 110 and 111 of liner 92 prior to attachment of liner 92 to grill 52. Still further, filter element 94 can be integrated with liner 92, such as being insert molded.

In any case, with this construction, essentially all of the air flow generated by the operation of blower 84 and drawn in through grill 52 must flow through filter element 94 in order to reach the side walls of plenum 80. That is, filter assembly 90 is functionally arranged in an opening 150 to plenum 80 such that plenum 80 is not directly exposed to the grease and other byproduct laden air directed through grill 52 during use of cooktop 9. Therefore, this arrangement advantageously minimizes any necessary cleaning within plenum 80. Instead, filter assembly 90 can be simply removed from plenum 80 and either cleaned or replaced. In the described embodiments wherein the filter element 94 is integrated into or otherwise fixed to liner 92, liner 92 could be cleaned or discarded with filter element 94. In the case of a drop-in filter cartridge, filter element 94 alone could be cleaned or replaced.

Although described with reference to preferred embodiments of the invention, it should be readily understood that various changes and/or modifications can be made to the invention without departing from the spirit thereof. For instance, although filter assembly 90 has been described as having both liner 92 and one or more filtering elements 94, it is contemplated that the filter element 94 itself could incorporate flanges in order to be directly attached to grill 52, thereby eliminating the need for liner 92. In addition, it should be realized that a wide range of attachments could be employed between filter assembly 90 and grill 52, including having liner 92 flex into engagement, employing clips, clamps or the like, or other known fastening arrangements. Furthermore, liner 92 and/or filter element 94 could seat directly at the opening 150 of plenum 80, such as on ledge 155, below grill 52. In any event, in general, the invention is only intended to be limited by the scope of the following claims.

We claim:

1. A downdraft cooking appliance comprising:

a cooktop formed with an opening;

a plurality of heating elements arranged about the cooktop;

a plenum including a plurality of walls disposed, at least in part, below the cooktop, said plenum having an opening disposed adjacent the plurality of heating elements;

a blower exposed to said plenum for developing a venting flow of air containing cooking byproducts through the opening and into the plenum from above the cooktop during a cooking operation;

a grill covering the opening, said grill having upper and lower surfaces; and a filter element suspended from the lower surface of the grill and projecting into the plenum, wherein the flow of air is directed through the filter prior to reaching the walls of the plenum in order to isolate the walls of the plenum from exposure to the cooking byproducts.

2. The downdraft cooking appliance according to claim 1, wherein the filter element is removably attached to the grill.

3. The downdraft cooking appliance according to claim 2, wherein the filter element forms part of a filter assembly, said filter assembly further including a liner supporting the filter element.

4. The downdraft cooking appliance according to claim 3, wherein the filter element is fixed to the liner.

5. The downdraft cooking appliance according to claim 4, wherein the filter element is insert molded into the liner.

6. The downdraft cooking appliance according to claim 4, wherein the liner is generally V-shaped in cross-section.

7. The downdraft cooking appliance according to claim 3, wherein the filter element is removably attached to the liner.

8. The downdraft cooking appliance according to claim 7, wherein the filter element is positioned inside the liner.

9. The downdraft cooking appliance according to claim 8, wherein the liner is generally V-shaped in cross-section.

10. The downdraft cooking appliance according to claim 2, wherein the filter element is slidably attached to the grill.

11. A downdraft cooking appliance comprising:

a cooktop formed with an opening;

a plurality of heating elements arranged about the cooktop;

a plenum including a plurality of walls disposed, at least in part, below the cooktop, said plenum leading to the opening so as to be exposed adjacent the plurality of heating elements;

a blower exposed to said plenum for developing a flow of air containing cooking byproducts through the opening and into the plenum from above the cooktop during a cooking operation;

a grill seated in and extending across the opening during operation of the blower; and a filter assembly arranged directly below the grill in the flow of air between the opening and the walls of the plenum, wherein the flow of air is drawn into the grill and then directed through the filter assembly prior to reaching the walls of the plenum in order to isolate the walls of the plenum from exposure to the cooking byproducts.

12. The downdraft cooking appliance according to claim 11, wherein the filter assembly is suspended from the grill.

13. The downdraft cooking appliance according to claim 12, wherein the filter assembly includes a filter element and a liner supporting the filter element.

14. The downdraft cooking appliance according to claim 13, wherein the filter element is fixed to the liner.

15. The downdraft cooking appliance according to claim 13, wherein the filter element is insert molded into the liner.

16. The downdraft cooking appliance according to claim 13, wherein the filter element is removably attached to the liner.

17. The downdraft cooking appliance according to claim 16, wherein the filter element is positioned inside the liner.

18. The downdraft cooking appliance according to claim 12, wherein the filter assembly is slidably attached to the grill.

19. The downdraft cooking appliance according to claim 11, wherein the filter assembly is generally V-shaped.

20. A method of operating a downdraft cooking appliance comprising:

directing a flow of venting air containing suspended cooking byproducts into an opening, provided adjacent a plurality of surface heating elements of the appliance, of a plenum including a plurality of walls arranged below a level of the plurality of surface heating elements;

causing the venting air to flow through a filter element, suspended from a lower side of a grill seated in the opening, prior to reaching the walls of the plenum, wherein the walls of the plenum are substantially, entirely isolated from the byproducts; and subsequently directing the venting air through the plenum.

21. The method according to claim 20, further comprising: removing the filter element from the plenum by manually lifting the grill from upon the downdraft cooking appliance.

22. The method according to claim 21, further comprising: detaching the filtering element from the grill for cleaning or replacement.

23. The method according to claim 22, further comprising: slidably detaching the filtering element from the grill.

24. The method according to claim 20, further comprising: supporting the filtering element through a liner.

25. The method according to claim 24, further comprising:

inserting the filtering element into the liner; and removing the filtering element from the liner for cleaning or replacement.

* * * * *